US010022591B2

(12) United States Patent
Back et al.

(10) Patent No.: US 10,022,591 B2
(45) Date of Patent: Jul. 17, 2018

(54) EXERCISE ASSISTANCE APPARATUS DETERMINING ASSISTANCE FORCE AND PHYSICAL FITNESS EQUIPMENT HAVING THE SAME

(71) Applicant: Ronfic Co., Ltd., Busan (KR)

(72) Inventors: Junyoung Back, Gyeongsangnam-do (KR); ChiBeom Noh, Busan (KR); SungMin Yoon, Busan (KR); JinChan Kim, Busan (KR)

(73) Assignee: Ronfic Co., Ltd., Busan (KR)

( * ) Notice: Subject to any disclaimer, the term of this patent is extended or adjusted under 35 U.S.C. 154(b) by 0 days.

(21) Appl. No.: 15/371,266

(22) Filed: Dec. 7, 2016

(65) Prior Publication Data

US 2018/0064994 A1 Mar. 8, 2018

(30) Foreign Application Priority Data

Sep. 7, 2016 (KR) ..... 10-2016-0114915

(51) Int. Cl.
*A63B 24/00* (2006.01)
*A63B 21/005* (2006.01)
*A63B 21/062* (2006.01)

(52) U.S. Cl.
CPC ..... *A63B 24/0087* (2013.01); *A63B 21/0058* (2013.01); *A63B 21/062* (2013.01); *A63B 2024/0093* (2013.01)

(58) Field of Classification Search
CPC ..... A63B 24/0087; A63B 21/0058; A63B 21/062; A63B 2024/0093
See application file for complete search history.

(56) References Cited

U.S. PATENT DOCUMENTS 6,494,811 B1 * 12/2002 Alessandri ..... A63B 21/0628 482/8
8,529,408 B2 * 9/2013 Bell ..... A63B 21/00069 482/8

(Continued)

FOREIGN PATENT DOCUMENTS

KR 10-0657716 B1 12/2006
KR 10-2010-0026062 A 3/2010

(Continued)

*Primary Examiner* — Glenn Richman
(74) *Attorney, Agent, or Firm* — IP Legal Services, LLC

(57) ABSTRACT

An exercise assistance apparatus includes a mounting unit, a power transmission unit, and an exercise assistance unit. The mounting unit is capable of detaching from a first direction frame of a weight training rack. The mounting unit is mounted on the first direction frame in parallel. The power transmission unit generates a power and transmitting the power. The power transmission unit is arranged at the mounting unit. The exercise assistance unit is coupled movably to the power transmission unit. The exercise assistance unit receives the power and exerting an external force on an exercise assistance and an exercise. The exercise assistance unit includes a housing case, at least one load detection member, a cover member and a microcomputer. The microcomputer calculates an external force value of the power transmission unit based on the calculated value and transmitting a control signal to the power transmission unit based on the external force value.

10 Claims, 8 Drawing Sheets

(56) References Cited

U.S. PATENT DOCUMENTS

| | | | | |
|---|---|---|---|---|
| 8,876,664 | B2 * | 11/2014 | Bell | A63B 21/00069 482/1 |
| 9,174,086 | B1 * | 11/2015 | Griggs | A63B 21/4029 |
| 9,833,662 | B2 * | 12/2017 | Potter | A63B 24/0087 |

FOREIGN PATENT DOCUMENTS

| | | | |
|---|---|---|---|
| KR | 10-2012-0123855 | A | 11/2012 |
| KR | 10-1425769 | B1 | 8/2014 |
| KR | 10-1636657 | B1 | 7/2016 |

* cited by examiner

EXERCISE ASSISTANCE APPARATUS DETERMINING ASSISTANCE FORCE AND PHYSICAL FITNESS EQUIPMENT HAVING THE SAME

CROSS REFERENCE TO PRIOR APPLICATIONS

The present application claims priority under 35 U.S.C. § 119 to Korean Patent Application No. 10-2016-0114915 (filed on Sep. 7, 2016).

BACKGROUND

1. Field

Example embodiments relate to exercise assistance apparatus determining assistance force and physical fitness equipment having the same. More particularly, example embodiments relate to exercise assistance apparatus assisting accurately weight training based on an electric control by without a couch, reducing personnel expenses, and having competitiveness and high added value.

2. Description of the Related Art

Weight training is a kind of a typical anaerobic exercise, and the weight training strengthens muscular strength by lifting weight and stimulating muscle. As interest in health and body height increases, the weight training becomes popular.

For the weight training, the weight such as barbell rods, barbell discs and dumbbells is needed. For systematic weight training, the weight should be kept by weight and racks are also needed for keeping the weight at a starting position of the weight training. The racks may include a power rack, a half rack and a multi rack. Basic functionality and configuration of each rack are simple such that the shapes of the racks are slightly different from each other but overall functionality and configuration of the racks are similar. The racks are expensive comparatively, and there is hardly any trouble such as failure such that once installed, the racks are used for a long time.

Conventionally, a technology assisting or performing the weight training electrically is disclosed. The technology should make users feel like that a couch helps the users by an assistance of an apparatus smoothly and naturally.

In an example embodiment of the technology, "LOAD REMOVAL APPARATUS FOR WEIGHT TRAINING" which is Korean Patent Registration No. 10-0657716 registered on Dec. 7, 2006 was proposed.

However, the conventional technology includes a lot of problems. When a position or a velocity detection value is only used in a timing decision for a removal of a load, a quantity of a removal of the load is constant such that the exercise cannot be assisted smoothly. When the quantity of the removal of the load is calculated by a feedback of the position or a velocity, the exercise cannot be assisted naturally by a slow reaction speed. Additionally, when a sensor is installed not at a rod but at an external portion, a precise control is difficult by a lot of error of a detected value.

When a calculation of an acceleration to enhance reactivity is used, malfunction due to noise occurs. When the sensor is installed at the rod, communication system to communicate the sensor with a controller is needed additionally.

In the weight training, muscles should be stimulated continually, and the weight training is performed to the fatigued muscles to enhance the effect of the weight training. The fatigued muscles are sensitive to changes in minute external forces. The effect of the weight training can increase or decrease corresponding to a minute strength of the external forces transmitted by the electric assistance apparatus. However, the conventional technology has a simple algorithm accepting data from external sensors. The conventional technology does not consider a reaction force by the exercise and a friction force of the apparatus such that the effect of the weight training by the conventional electric assistance apparatus decreases.

Prior arts are Korean Patent Registration No. 10-0657716 registered on Dec. 7, 2006, Korean Patent Registration No. 10-1425769 registered on Jul. 25, 2014, Korean Patent Publication No. 10-2010-0026062 published on Mar. 10, 2010 and Korean Patent Publication No. 10-2012-0123855 published on Nov. 12, 2012.

SUMMARY

Example embodiments provide a physical fitness equipment assisting accurately weight training based on an electric control by without a couch, reducing personnel expenses, and having competitiveness and high added value.

According to example embodiments, there is provided an exercise assistance apparatus. The exercise assistance apparatus includes a mounting unit, a power transmission unit, and an exercise assistance unit. The mounting unit is capable of detaching from a first direction frame of a weight training rack. The mounting unit is mounted on the first direction frame in parallel. The power transmission unit generates a power and transmitting the power. The power transmission unit is arranged at the mounting unit. The exercise assistance unit is coupled movably to the power transmission unit. The exercise assistance unit receives the power and exerting an external force on an exercise assistance and an exercise. The exercise assistance unit includes a housing case, at least one load detection member, a cover member and a microcomputer. The housing case has an enclosed shape. The housing case includes an opening portion at a top surface and an ending portion coupled to the power transmission unit. The at least one load detection member is mounted in the housing case. The at least one load detection member detects a load applied at an upper portion. The cover member covers the opening portion of the housing case. The cover member transfers the load to the at least one load detection member. The microcomputer is provided in the housing case or the power transmission unit. The microcomputer calculates a calculated value of an exercise assistance time and an exercise assistance strength based on an encoder signal transmitted from a driving portion of the power transmission unit generating a rotational driving force. The microcomputer calculates an external force value of the power transmission unit based on the calculated value and transmitting a control signal to the power transmission unit based on the external force value.

In example embodiments, the exercise assistance unit may further include a guide rail provided in the cover member, a moving body moving along the guide rail, an installation plate fixed at an upper portion of the moving body and a protection body covering the guide rail to protect the guide rail and exposing the installation plate.

In example embodiments, the at least one load detection member may include a plurality of load cells. The exercise assistance unit may further include a load transmission member provided between the load cells and the cover member. The load transmission member may transfer the load applied the cover member to the load cells.

In example embodiments, the mounting unit may include a mounting pin, a first mounting base and a second mounting base. The mounting pin may be installed through the first direction frame. The mounting pin may have a rod shape. The first mounting base may have a cross-sectional shape of a rectangular without one sideline. The first mounting base may include a first latching groove catching the mounting pin. The second mounting base may have a cross-sectional shape of a rectangular without one sideline. The power transmission unit may be fixed to the second mounting base. The second mounting base may include a second latching groove catching the mounting pin. The power transmission unit may include a housing having an inner space, the housing fixed to the mounting unit in parallel, a motor arranged in the housing, a ball screw extending in a first direction and a ball screw nut moving in the first direction or an opposite direction of the first direction by the power of the motor transmitted by the ball screw. The ball screw may transmit a power of the motor. The exercise assistance unit may be coupled to the ball screw nut.

In example embodiments, the microcomputer may save the load detected by the load cells as an initial weight value before the exercise. The microcomputer may determine exercise staring time when the initial weight value is substantially equal to zero. The microcomputer may drive the exercise assistance unit when the load detected by the load cells is greater than the initial weight value and a load detection time of the load cells is greater than a predetermined time. The microcomputer may receive a real-time weight value from the load cells. The microcomputer calculates a torque based on a comparison value between the initial weight value and the real-time weight value. The microcomputer may control the motor reversely based on the calculated the torque.

According to example embodiments, there is provided a physical fitness equipment. The physical fitness equipment includes a weight training rack including a first direction frame and an exercise assistance apparatus. The exercise assistance apparatus includes a mounting unit, a power transmission unit, and an exercise assistance unit. The mounting unit is capable of detaching from the first direction frame of the weight training rack. The mounting unit is mounted on the first direction frame in parallel. The power transmission unit generates a power and transmitting the power. The power transmission unit is arranged at the mounting unit. The exercise assistance unit is coupled movably to the power transmission unit. The exercise assistance unit receives the power and exerting an external force on an exercise assistance and an exercise. The exercise assistance unit includes a housing case, at least one load detection member, a cover member and a microcomputer. The housing case has an enclosed shape. The housing case includes an opening portion at a top surface and an ending portion coupled to the power transmission unit. The at least one load detection member is mounted in the housing case. The at least one load detection member detects a load applied at an upper portion. The cover member covers the opening portion of the housing case. The cover member transfers the load to the at least one load detection member. The microcomputer is provided in the housing case or the power transmission unit. The microcomputer calculates a calculated value of an exercise assistance time and an exercise assistance strength based on an encoder signal transmitted from a driving portion of the power transmission unit generating a rotational driving force. The microcomputer calculates an external force value of the power transmission unit based on the calculated value and transmitting a control signal to the power transmission unit based on the external force value.

In example embodiments, the exercise assistance unit may further include a guide rail provided in the cover member, a moving body moving along the guide rail, an installation plate fixed at an upper portion of the moving body and a protection body covering the guide rail to protect the guide rail and exposing the installation plate.

In example embodiments, the at least one load detection member may include a plurality of load cells. The exercise assistance unit may further include a load transmission member provided between the load cells and the cover member. The load transmission member may transfer the load applied the cover member to the load cells.

In example embodiments, the mounting unit may include a mounting pin, a first mounting base and a second mounting base. The mounting pin may be installed through the first direction frame. The mounting pin may have a rod shape. The first mounting base may have a cross-sectional shape of a rectangular without one sideline. The first mounting base may include a first latching groove catching the mounting pin. The second mounting base may have a cross-sectional shape of a rectangular without one sideline. The power transmission unit may be fixed to the second mounting base. The second mounting base may include a second latching groove catching the mounting pin. The power transmission unit may include a housing having an inner space, the housing fixed to the mounting unit in parallel, a motor arranged in the housing, a ball screw extending in a first direction and a ball screw nut moving in the first direction or an opposite direction of the first direction by the power of the motor transmitted by the ball screw. The ball screw may transmit a power of the motor. The exercise assistance unit may be coupled to the ball screw nut.

In example embodiments, the microcomputer may save the load detected by the load cells as an initial weight value before the exercise. The microcomputer may determine exercise staring time when the initial weight value is substantially equal to zero. The microcomputer may drive the exercise assistance unit when the load detected by the load cells is greater than the initial weight value and a load detection time of the load cells is greater than a predetermined time. The microcomputer may receive a real-time weight value from the load cells. The microcomputer calculates a torque based on a comparison value between the initial weight value and the real-time weight value. The microcomputer may control the motor reversely based on the calculated the torque.

According to the exercise assistance apparatus and the physical fitness equipment, the weight training of users may be assisted accurately without a couch by an electric control such that personnel expenses decrease.

Additionally, not based on a position or a velocity but based on a real load, the exercise can be assisted such that the users can perform natural weight training smoothly.

The present invention has the effect of being able to be commercialized through optimized design of the components for the exercise assistance, and the present invention provides competitive and high value-added physical fitness equipment.

BRIEF DESCRIPTION OF THE DRAWINGS

Example embodiments will be more clearly understood from the following detailed description taken in conjunction with the accompanying drawings.

FIG. 1 is a perspective view illustrating a physical fitness equipment according to example embodiment.

FIG. 2 is a perspective view illustrating a mounting unit of FIG. 1.

FIG. 3 is a disassembled perspective view illustrating a power transmission unit of FIG. 1.

FIG. 4 is a disassembled perspective view illustrating an exercise assistance unit of FIG. 1 according to example embodiment.

FIG. 5 is an assembled perspective view illustrating an exercise assistance unit of FIG. 4.

FIG. 6 is a disassembled perspective view illustrating an exercise assistance unit of FIG. 1 according to example embodiment.

FIG. 7 is an assembled perspective view illustrating an exercise assistance unit of FIG. 6.

FIG. 8 is a flow-chart illustrating an exercise assistance algorithm in the exercise assistance unit.

DETAILED DESCRIPTION OF THE EMBODIMENTS

Figure 1:
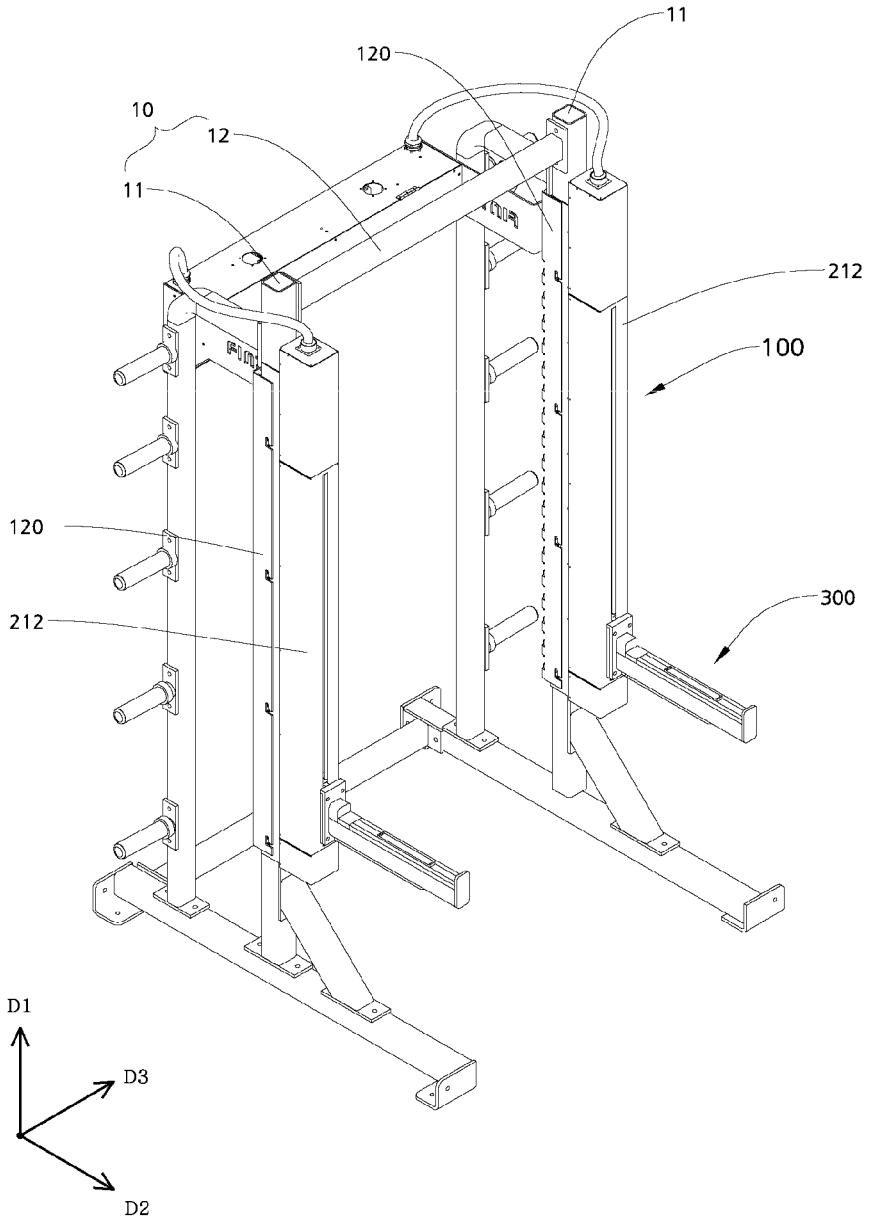
FIGS. 1 to 8 represent non-limiting, example embodiments as described herein.

Various example embodiments will be described more fully hereinafter with reference to the accompanying drawings, in which some example embodiments are shown. The present inventive concept may, however, be embodied in many different forms and should not be construed as limited to the example embodiments set forth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
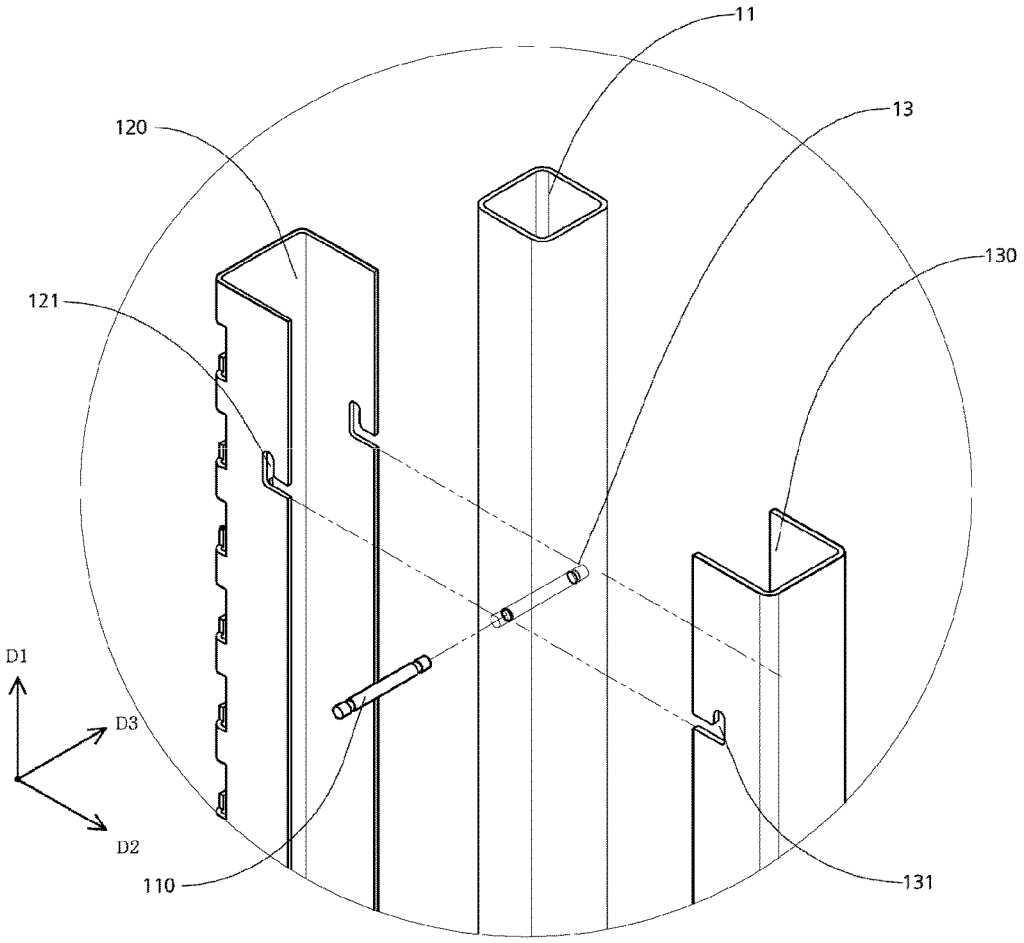
Figure 3:
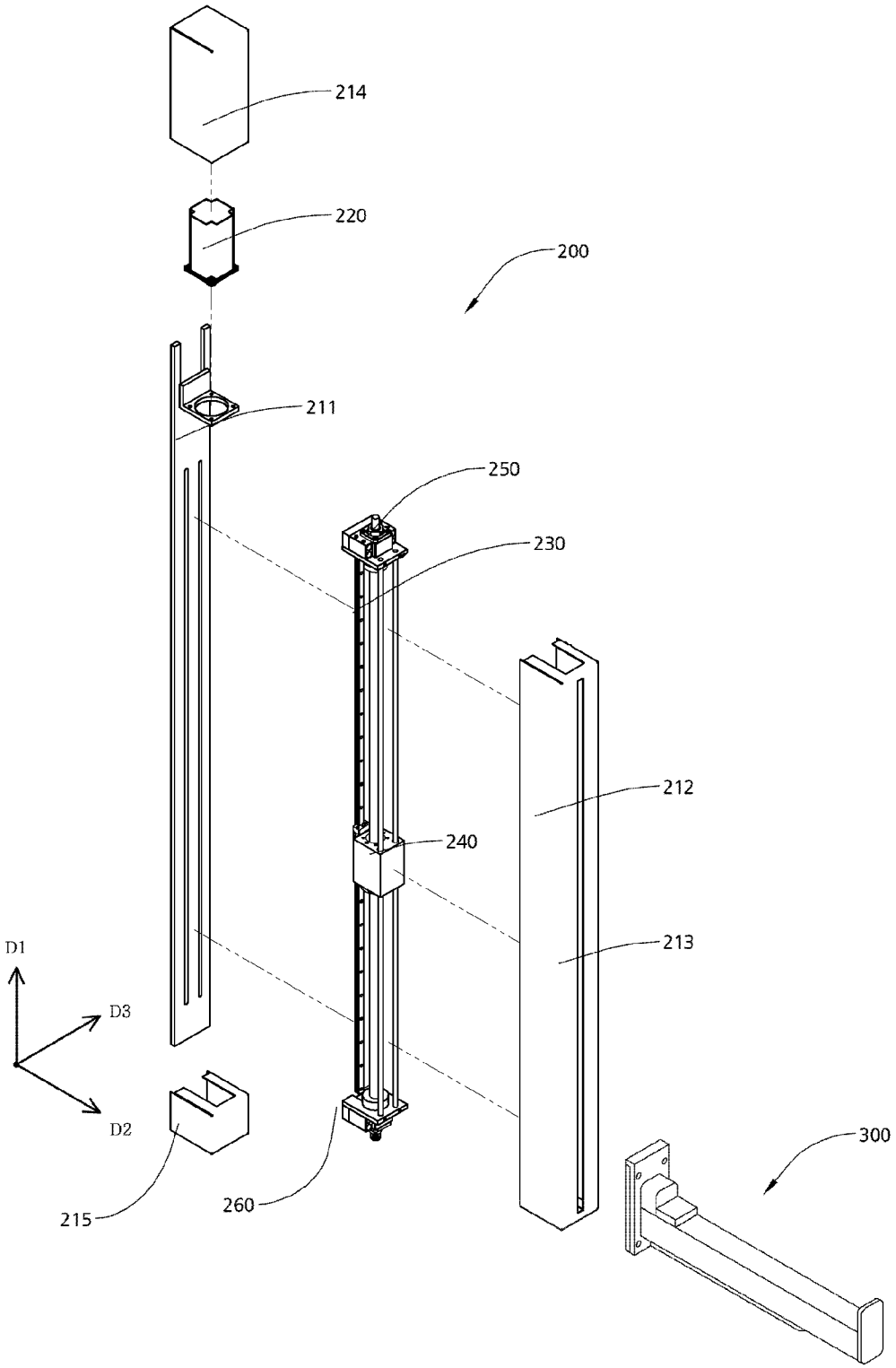

FIG. 1 is a perspective view illustrating a physical fitness equipment according to example embodiment. FIG. 2 is a perspective view illustrating a mounting unit of FIG. 1. FIG. 3 is a disassembled perspective view illustrating a power transmission unit of FIG. 1.

Referring to FIGS. 1 to 3, a physical fitness equipment includes a weight training rack 10 and an exercise assistance apparatus. The exercise assistance apparatus includes a mounting unit 100, a power transmission unit 200 and an exercise assistance unit 300. The mounting unit may be capable of detaching from a first direction frame 11 (for example, a vertical frame) of the weight training rack 10. The mounting unit 100 may be mounted on the first direction frame 11 in parallel. The power transmission unit 200 may generate a power and transmitting the power. The power transmission unit 200 may be arranged at the mounting unit 100. The exercise assistance unit 300 may be coupled movably to the power transmission unit 200. The exercise assistance unit 300 may receive the power and may exert an external force on an exercise assistance and an exercise.

The weight training rack 10 may include a pair of first direction frames 11 each of which extends in a first direction D1 and a second direction frame 12 (for example, a horizontal frame) arranged between the first direction frames 11. The second direction frame 12 may extend in a second direction D3 crossing the first direction D1.

The mounting unit 100 may include a mounting pin 110, a first mounting base 120 and a second mounting base 130. The mounting pin 110 may be installed through a mounting hole 12 of the first direction frame 11. The mounting pin 100 may have a rod shape. The first mounting base 120 may have a cross-sectional shape of a rectangular without one sideline. The first mounting base 120 may include a first latching groove 121 catching the mounting pin 110. The second mounting base 130 may have a cross-sectional shape of a rectangular without one sideline. The power transmission unit 200 may be fixed to the second mounting base 130. The second mounting base 130 may include a second latching groove 131 catching the mounting pin 110.

The mounting unit 100 may be installed through the mounting hole 12 of the first direction frame 11 of the weight training rack 10, the mounting hole 12 may be provided at any frames of any racks such that the mounting unit 100 may be easily mounted on any racks.

As illustrated in FIG. 3, the power transmission unit 200 may include a housing 211 and 212 having an inner space which is fixed to the mounting unit 100 in parallel, a motor 220 arranged in an end portion of the housing 211 and 212 which generates a power, a ball screw 230 arranged in the inner space of the housing 211 and 212 which extends in the first direction D1 which transmits the power of the motor 220 and a ball screw nut 240 moving in the first direction D1 or an opposite direction of the first direction D1 by the power of the motor 220 transmitted by the ball screw 230 which arranged on a screw of the ball screw 230.

The housing 211 and 212 may include a fix plate member 211 including a fixing member to fix the motor 220 and a cover member 212 having a moving groove extending in the first direction D1 to guide a movement of the exercise assistance unit 300.

Additionally, the power transmission unit 200 may include a motor cover member 214 to cover the motor 220 and a support cover member 215 covering the rotational support 260.

The present invention may include a belt (not shown) to transmit the power of the motor 220 and a pulley (not shown) supporting and rotating the belt instead of the ball screw 230 and the ball screw nut 240.

Additionally, the motor 220 may transfer the power to the ball screw 230 through a motor connection portion 250. The ball screw 230 may be supported and rotated by the rotational support 260.

The motor 220 may be controlled by a microcomputer of the exercise assistance unit 300, and the motor 200 may transmit an encoder signal.

The ball screw nut 240 may be arranged at the screw of the ball screw 230 to move in the first direction D1 or the opposite direction of the first direction D1 and to transmit the power of the motor 220 to the exercise assistance unit 300. For example, the ball screw nut 240 may be precisely moved in the first direction D1 or the opposite direction of the first direction D1 with about 1 mm scale in accordance with a movement of the motor 220.

The exercise assistance unit 300 may be explained in detail with reference to the figures.

Figure 4:
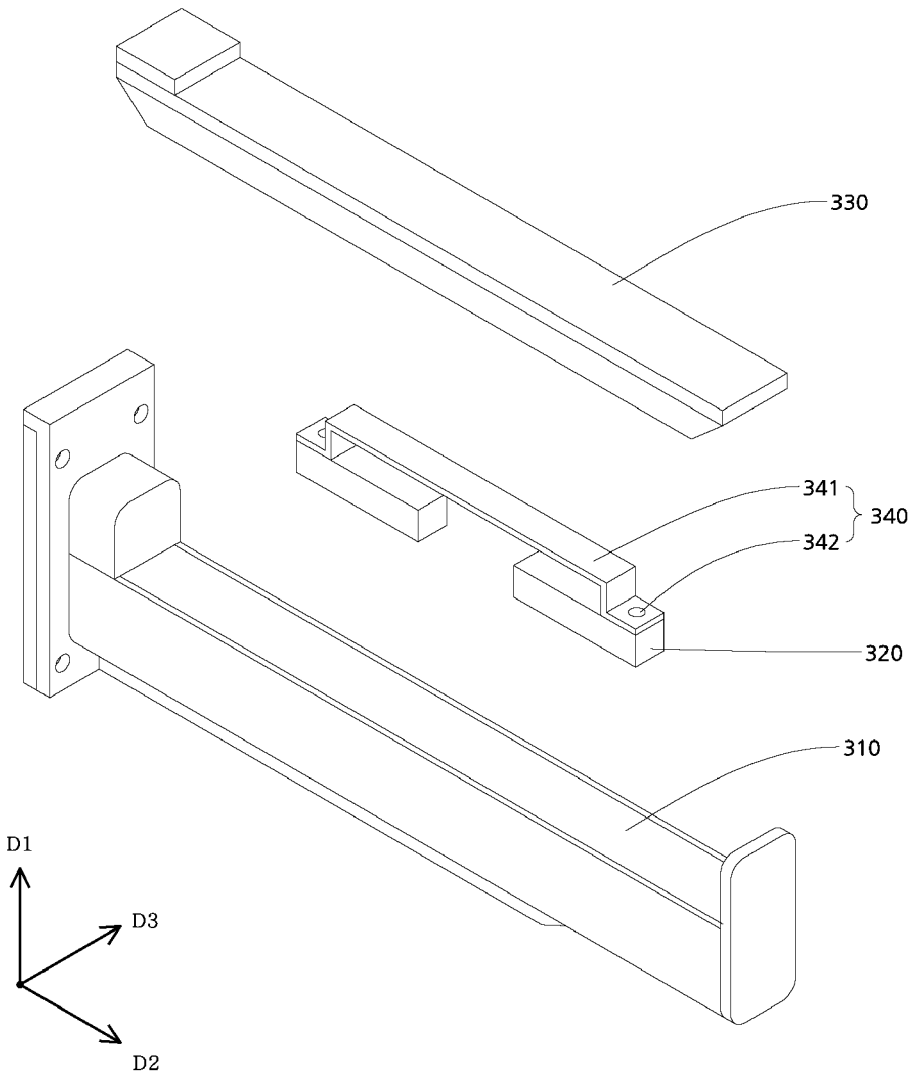
Figure 5:
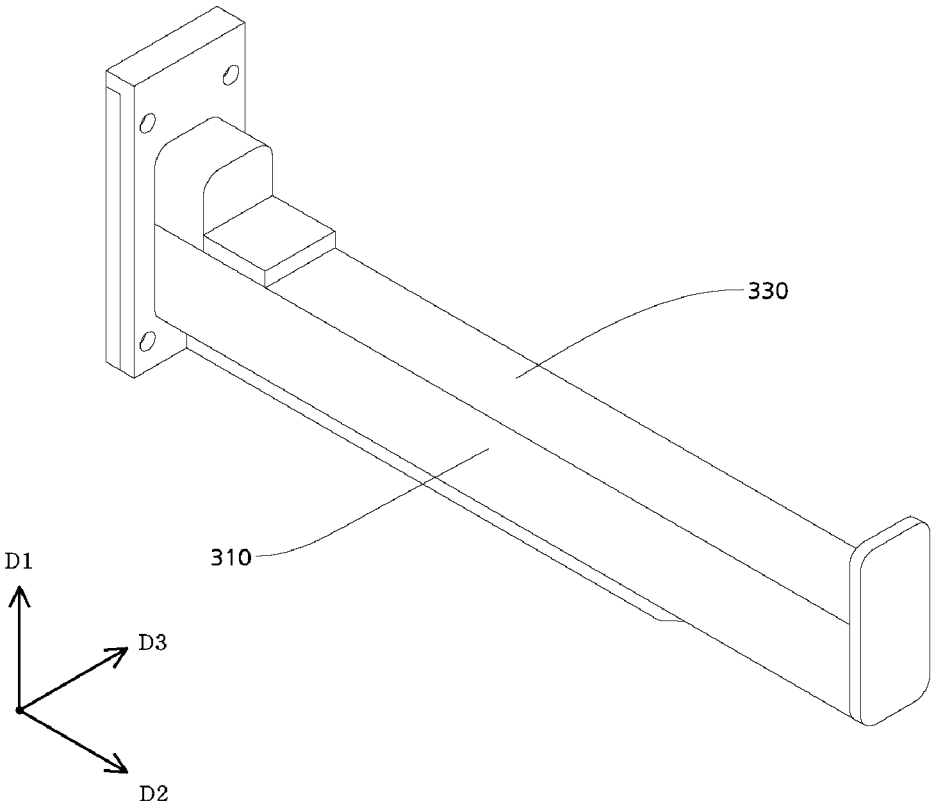

FIG. 4 is a disassembled perspective view illustrating an exercise assistance unit of FIG. 1 according to example embodiment. FIG. 5 is an assembled perspective view illustrating an exercise assistance unit of FIG. 4.

Referring to FIGS. 4 and 5, the exercise assistance unit 300 may be coupled movably to the power transmission unit 200. The exercise assistance unit 300 may receive the power and exerting an external force on an exercise assistance and an exercise.

The exercise assistance unit 300 may include a housing case 310, at least one load detection member, a cover member 330 and the microcomputer.

The housing case 310 may have an enclosed shape. The housing case 310 may include an opening portion at a top surface and an ending portion coupled to the power transmission unit 200.

The at least one load detection member may be mounted in the housing case 310. The at least one load detection member may detect a load applied at an upper portion. The at least one load detection member includes a plurality of load cells 320.

The cover member 330 may cover the opening portion of the housing case 310. The cover member 330 may transfer the load to the at least one load detection member.

The microcomputer may be provided in the housing case 310 or the power transmission unit 200. The microcomputer may calculate a calculated value of an exercise assistance time and an exercise assistance strength based on the encoder signal transmitted from the motor 220 of the power transmission unit 200. The microcomputer may calculate an external force value of the power transmission unit 200 based on the calculated value, and the microcomputer may transmit a control signal to the power transmission unit 200 based on the external force value.

In example embodiment, the exercise assistance unit 300 may further include a load transmission member 340 provided between the load cells 320 and the cover member 330. The load transmission member 340 may transfer the load applied the cover member 330 to the load cells 320.

The load transmission member 340 may include a contact portion 341 contacting a surface of the cover member 330 and a fixing portion 342 fixed to the load cells 320 extending from the contact portion 341 to the load cells 320.

Figure 6:
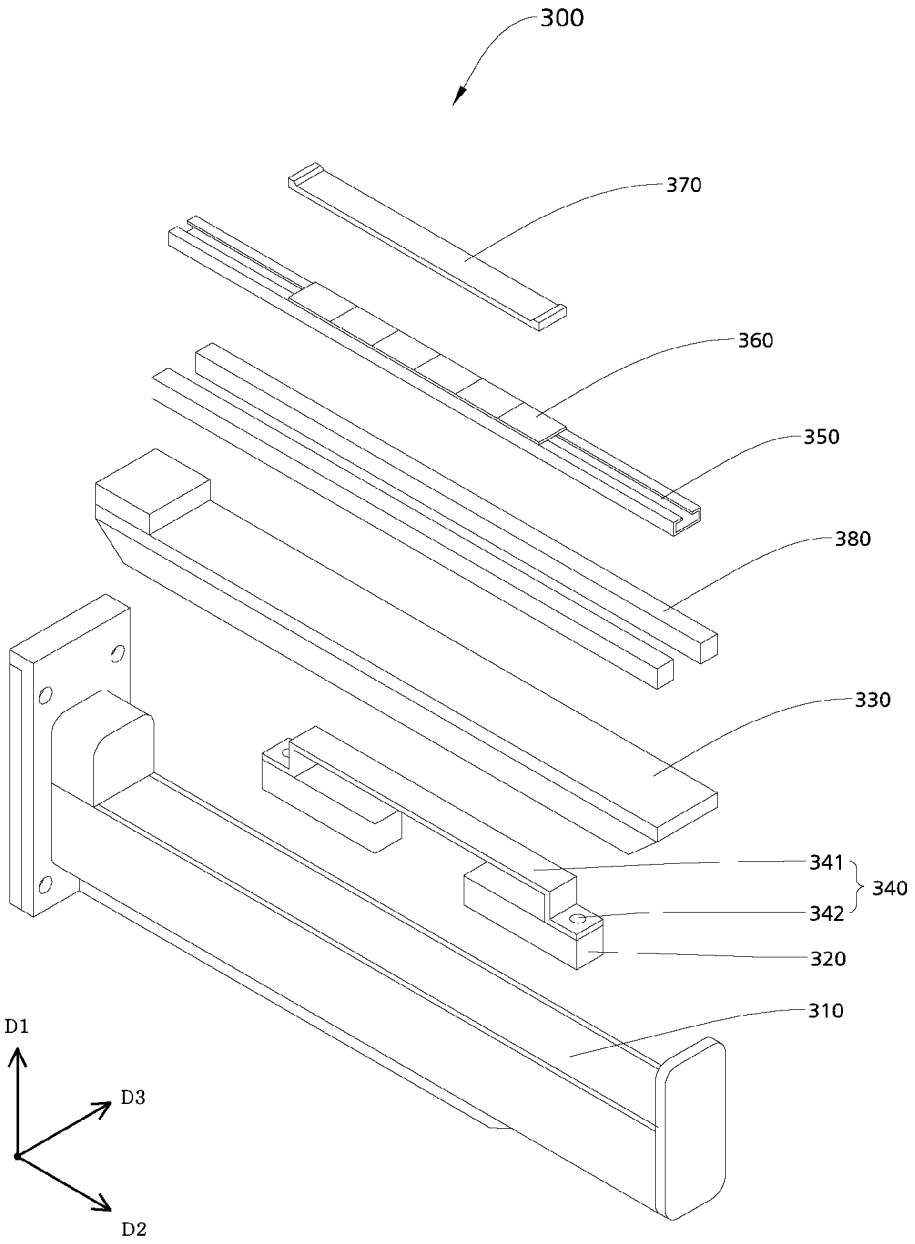
Figure 7:
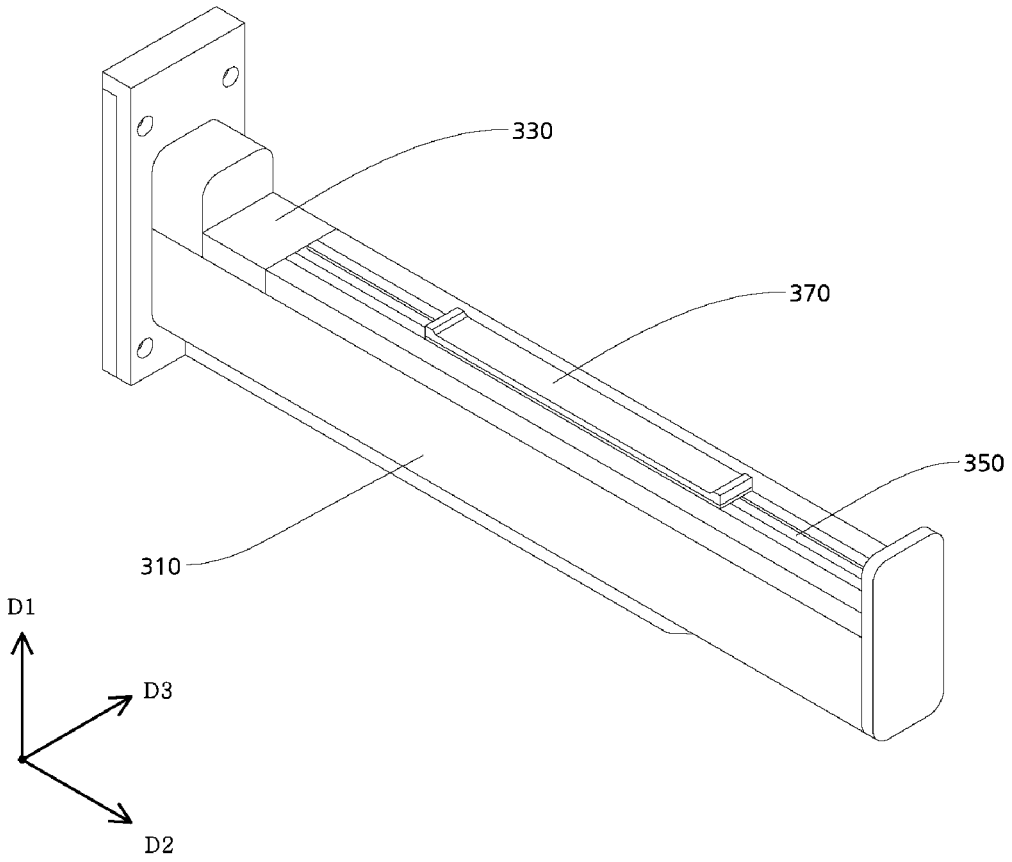

FIG. 6 is a disassembled perspective view illustrating an exercise assistance unit of FIG. 1 according to example embodiment. FIG. 7 is an assembled perspective view illustrating an exercise assistance unit of FIG. 6.

Referring to FIGS. 6 and 7, the exercise assistance unit 300 may include a housing case 310, at least one load detection member, a cover member 330, the microcomputer, a guide rail 350 provided in the cover member 330, a moving body 360 moving along the guide rail 350, an installation plate 370 fixed at an upper portion of the moving body 360 and a protection body 380 covering the guide rail 350 to protect the guide rail 350 and exposing the installation plate 370.

The housing case 310 may have an enclosed shape. The housing case 310 may include an opening portion at a top surface and an ending portion coupled to the power transmission unit 200.

The at least one load detection member may be mounted in the housing case 310. The at least one load detection member may detect a load applied at an upper portion. The at least one load detection member includes a plurality of load cells 320.

The cover member 330 may cover the opening portion of the housing case 310. The cover member 330 may transfer the load to the at least one load detection member.

The microcomputer may be provided in the housing case 310 or the power transmission unit 200. The microcomputer may calculate a calculated value of an exercise assistance time and an exercise assistance strength based on the encoder signal transmitted from the motor 220 of the power transmission unit 200. The microcomputer may calculate an external force value of the power transmission unit 200 based on the calculated value, and the microcomputer may transmit a control signal to the power transmission unit 200 based on the external force value.

In example embodiment, the exercise assistance unit 300 may further include a load transmission member 340 provided between the load cells 320 and the cover member 330. The load transmission member 340 may transfer the load applied the cover member 330 to the load cells 320.

By the guide rail 350, the moving body 350 and the installation plate 370, barbells arranged on the installation plate 370 may be moved not only in the first direction D1 but also in the second direction D3 such that degree of freedom of exercise increase and a friction decreases.

Figure 8:
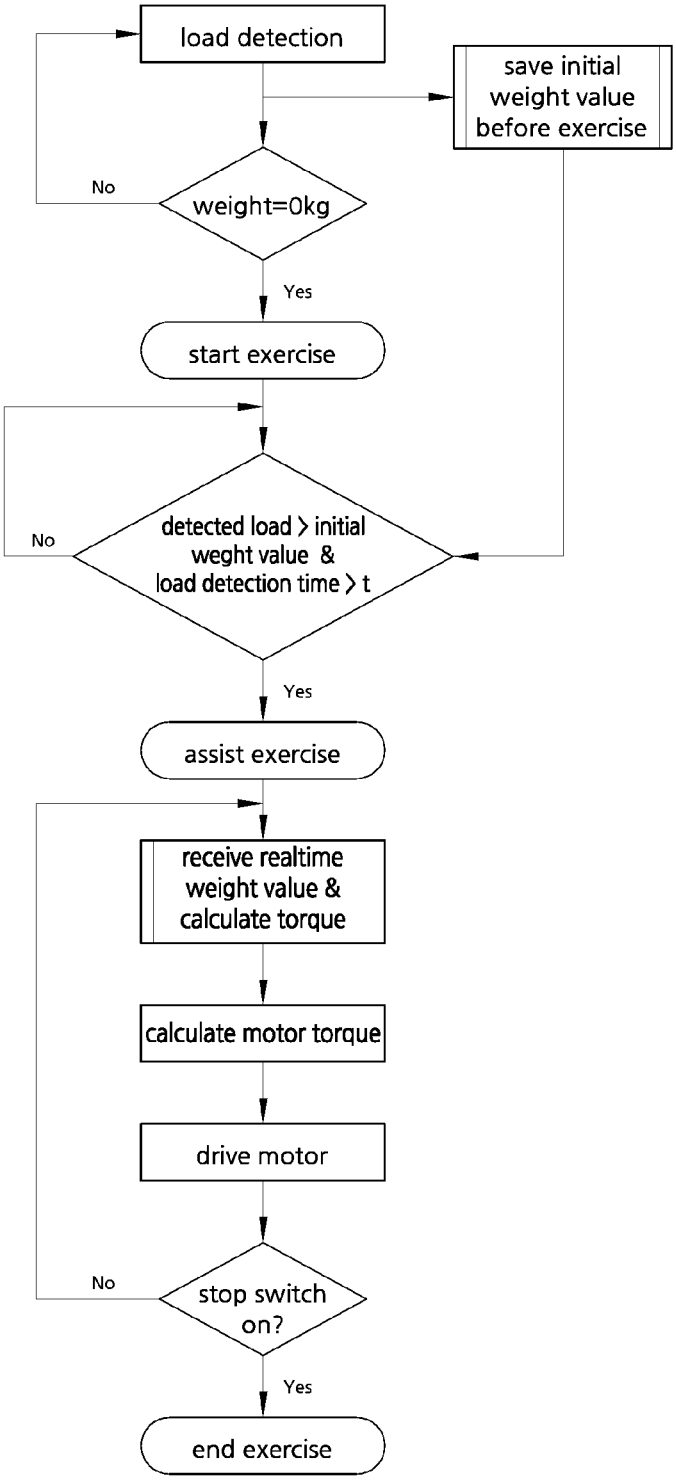

FIG. 8 is a flow-chart illustrating an exercise assistance algorithm in the exercise assistance unit.

Referring to FIG. 8, weight such as barbells or dumbbells may be located at the cover member 330 or the installation plate 370. The microcomputer may save a load detected by the load cells 320 as an initial weight value before the exercise.

The microcomputer may determine exercise staring time when the initial weight value is substantially equal to zero, and then, the microcomputer may drive the exercise assistance unit 300 to assist the exercise when the load detected by the load cells 320 is greater than the initial weight value and a load detection time of the load cells is greater than a predetermined time.

And then, the microcomputer may receive a real-time weight value from the load cells 320. The microcomputer calculates a torque based on a comparison value between the initial weight value and the real-time weight value. The microcomputer may control the motor 220 reversely based on the calculated the torque to move the exercise assistance unit 300.

And then, when a stop switch at the exercise assistance apparatus is on, the exercise may be terminated and the exercise assistance unit 300 may be returned to an initial position.

The microcomputer may calculate perturbation value by using SMCSPO (Sliding Mode Control with Sliding Perturbation Observer) algorithm based on the encoder signal. The microcomputer may calculate an external force by a subtraction a friction force from the calculated perturbation value. The microcomputer may apply the external force to a low pass filter such that the microcomputer may calculate a final external force estimation value including an accurate assistance external force, time and a position to exert the force.

According to the exercise assistance apparatus and the physical fitness equipment, the weight training of users may be assisted accurately without a couch by an electric control such that personnel expenses decrease.

Additionally, not based on a position or a velocity but based on a real load, the exercise can be assisted such that the users can perform natural weight training smoothly.

The present invention has the effect of being able to be commercialized through optimized design of the components for the exercise assistance, and the present invention provides competitive and high value-added physical fitness equipment.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An exercise assistance apparatus comprising:

a mounting unit capable of detaching from a first direction frame of a weight training rack, the mounting unit mounted on the first direction frame in parallel;

a power transmission unit generating a power and transmitting the power, the power transmission unit arranged at the mounting unit; and an exercise assistance unit coupled movably to the power transmission unit, the exercise assistance unit receiving the power and exerting an external force on an exercise assistance and an exercise, the exercise assistance unit including:

a housing case having an enclosed shape, the housing case including an opening portion at a top surface and an ending portion coupled to the power transmission unit;

at least one load detection member mounted in the housing case, the at least one load detection member detecting a load applied at an upper portion;

a cover member covering the opening portion of the housing case, the cover member transferring the load to the at least one load detection member; and a microcomputer provided in the housing case or the power transmission unit, the microcomputer calculating a calculated value of an exercise assistance time and an exercise assistance strength based on an encoder signal transmitted from a driving portion of the power transmission unit generating a rotational driving force, the microcomputer calculating an external force value of the power transmission unit based on the calculated value and transmitting a control signal to the power transmission unit based on the external force value.

2. The exercise assistance apparatus of claim 1, the exercise assistance unit further comprising:

a guide rail provided in the cover member;

a moving body moving along the guide rail;

an installation plate fixed at an upper portion of the moving body; and a protection body covering the guide rail to protect the guide rail and exposing the installation plate.

3. The exercise assistance apparatus of claim 2, wherein the at least one load detection member includes a plurality of load cells, wherein the exercise assistance unit further includes a load transmission member provided between the load cells and the cover member, and wherein the load transmission member transfers the load applied the cover member to the load cells.

4. The exercise assistance apparatus of claim 3, the mounting unit comprising:

a mounting pin installed through the first direction frame, the mounting pin having a rod shape;

a first mounting base having a cross-sectional shape of a rectangular without one sideline, the first mounting base including a first latching groove catching the mounting pin; and a second mounting base having a cross-sectional shape of a rectangular without one sideline, the power transmission unit fixed to the second mounting base, the second mounting base including a second latching groove catching the mounting pin, and the power transmission unit comprising:

a housing having an inner space, the housing fixed to the mounting unit in parallel;

a motor arranged in the housing;

a ball screw extending in a first direction, the ball screw transmitting a power of the motor; and a ball screw nut moving in the first direction or an opposite direction of the first direction by the power of the motor transmitted by the ball screw, wherein the exercise assistance unit is coupled to the ball screw nut.

5. The exercise assistance apparatus of claim 4, wherein the microcomputer saves the load detected by the load cells as an initial weight value before the exercise, wherein the microcomputer determines exercise staring time when the initial weight value is substantially equal to zero, wherein the microcomputer drives the exercise assistance unit when the load detected by the load cells is greater than the initial weight value and a load detection time of the load cells is greater than a predetermined time, and wherein the microcomputer receives a real-time weight value from the load cells, the microcomputer calculates a torque based on a comparison value between the initial weight value and the real-time weight value, and the microcomputer controls the motor reversely based on the calculated the torque.

6. A physical fitness equipment comprising:

a weight training rack including a first direction frame; and an exercise assistance apparatus, the exercise assistance apparatus including:

a mounting unit capable of detaching from the first direction frame of the weight training rack, the mounting unit mounted on the first direction frame in parallel;

a power transmission unit generating a power and transmitting the power, the power transmission unit arranged at the mounting unit; and an exercise assistance unit coupled movably to the power transmission unit, the exercise assistance unit receiving the power and exerting an external force on an exercise assistance and an exercise, the exercise assistance unit including:

a housing case having an enclosed shape, the housing case including an opening portion at a top surface and an ending portion coupled to the power transmission unit;

at least one load detection member mounted in the housing case, the at least one load detection member detecting a load applied at an upper portion;

a cover member covering the opening portion of the housing case, the cover member transferring the load to the at least one load detection member; and a microcomputer provided in the housing case or the power transmission unit, the microcomputer calculating a calculated value of an exercise assistance time and an exercise assistance strength based on an encoder signal transmitted from a driving portion of the power transmission unit generating a rotational driving force, the microcomputer calculating an external force value of the power transmission unit based on the calculated value and transmitting a control signal to the power transmission unit based on the external force value.

7. The physical fitness equipment of claim 6, the exercise assistance unit further comprising:

a guide rail provided in the cover member;

a moving body moving along the guide rail;

an installation plate fixed at an upper portion of the moving body; and a protection body covering the guide rail to protect the guide rail and exposing the installation plate.

8. The physical fitness equipment of claim 7, wherein the at least one load detection member includes a plurality of load cells, wherein the exercise assistance unit further includes a load transmission member provided between the load cells and the cover member, and wherein the load transmission member transfers the load applied the cover member to the load cells.

9. The physical fitness equipment of claim 8, the mounting unit comprising:

a mounting pin installed through the first direction frame, the mounting pin having a rod shape;

a first mounting base having a cross-sectional shape of a rectangular without one sideline, the first mounting base including a first latching groove catching the mounting pin; and a second mounting base having a cross-sectional shape of a rectangular without one sideline, the power transmission unit fixed to the second mounting base, the second mounting base including a second latching groove catching the mounting pin, and the power transmission unit comprising:

a housing having an inner space, the housing fixed to the mounting unit in parallel;

a motor arranged in the housing;

a ball screw extending in a first direction, the ball screw transmitting a power of the motor; and a ball screw nut moving in the first direction or an opposite direction of the first direction by the power of the motor transmitted by the ball screw, wherein the exercise assistance unit is coupled to the ball screw nut.

10. The physical fitness equipment of claim 9, wherein the microcomputer saves the load detected by the load cells as an initial weight value before the exercise, wherein the microcomputer determines exercise staring time when the initial weight value is substantially equal to zero, wherein the microcomputer drives the exercise assistance unit when the load detected by the load cells is greater than the initial weight value and a load detection time of the load cells is greater than a predetermined time, and wherein the microcomputer receives a real-time weight value from the load cells, the microcomputer calculates a torque based on a comparison value between the initial weight value and the real-time weight value, and the microcomputer controls the motor reversely based on the calculated the torque.

* * * * *